US008116657B2

(12) United States Patent
Kant et al.

(10) Patent No.: US 8,116,657 B2
(45) Date of Patent: Feb. 14, 2012

(54) UPPER SEAL FOR INHIBITING DOCTOR BLADE TONER LEAKAGE

(75) Inventors: Benjamin Erich Kant, Lexington, KY (US); Lenci Robert Kappes, Kalispell, MT (US)

(73) Assignee: Lexmark International, Inc., Lexington, KY (US)

( * ) Notice: Subject to any disclaimer, the term of this patent is extended or adjusted under 35 U.S.C. 154(b) by 922 days.

(21) Appl. No.: 11/959,016

(22) Filed: Dec. 18, 2007

(65) Prior Publication Data

US 2009/0154950 A1 Jun. 18, 2009

(51) Int. Cl.
*G03G 15/08* (2006.01)

(52) U.S. Cl. ..... 399/103; 399/102; 399/284

(58) Field of Classification Search ..... 399/103, 399/102, 284, 105, 274
See application file for complete search history.

(56) References Cited

U.S. PATENT DOCUMENTS

| | | | |
|---|---|---|---|
| 3,809,012 | A | 5/1974 | Delvecchio |
| 3,985,436 | A | 10/1976 | Tanaka et al. |
| 4,218,131 | A | 8/1980 | Ito et al. |
| 4,400,082 | A | 8/1983 | Kiba |
| 4,498,760 | A | 2/1985 | Sugiyama |
| 4,500,195 | A | 2/1985 | Hosono |
| 4,540,268 | A | 9/1985 | Toyono et al. |
| 4,564,283 | A | 1/1986 | Fox et al. |
| 4,616,919 | A | 10/1986 | Adley et al. |
| 4,627,701 | A | 12/1986 | Onoda et al. |
| 4,681,426 | A | 7/1987 | Bean et al. |
| 4,779,119 | A | 10/1988 | Kaieda |
| 4,791,454 | A | 12/1988 | Takahashi et al. |
| 4,802,928 | A | 2/1989 | Dunlap |
| 4,819,030 | A | 4/1989 | Shibano |
| 4,821,672 | A | 4/1989 | Bruno |
| 4,862,209 | A | 8/1989 | Sakamoto et al. |
| 4,870,449 | A | 9/1989 | Brown |
| 4,893,151 | A | 1/1990 | Yamazaki et al. |
| 4,905,047 | A | 2/1990 | Ariyama |
| 4,937,632 | A | 6/1990 | Kamidaira |

(Continued)

FOREIGN PATENT DOCUMENTS

JP 2001-134081 A 5/2001

OTHER PUBLICATIONS

International Search Report and Written Opinion of the International Searching Authority dated Feb. 17, 2009 for PCT Application No. PCT/US2008/087534.

(Continued)

*Primary Examiner* — Susan Lee
(74) *Attorney, Agent, or Firm* — John Victor Pezdek

(57) ABSTRACT

A seal assembly for inhibiting toner leakage comprises a j-seal received by a developer housing in a toner cartridge. The j-seal has an upper seat portion engagably sealing with a doctor blade seal and a leg for slidably sealing of a developer roll. The upper seat portion has an upper seat inner seal wall and an upper seat outer seal wall spaced apart a preselected distance from said upper seat inner seal wall and defining a gap therebetween. A doctor blade seal engages the upper seat inner and outer seal walls and a doctor blade bracket assembly disposed adjacent the j-seal and the doctor blade seal. The doctor blade seal further has a tongue disposed within the gap for interlocking said j-seal and sealably engaging the doctor blade bracket assembly.

21 Claims, 7 Drawing Sheets

U.S. PATENT DOCUMENTS

| | | | | |
|---|---|---|---|---|
| 4,947,216 | A | 8/1990 | Surti | |
| 5,021,830 | A | 6/1991 | Koiso | |
| 5,029,316 | A | 7/1991 | Koiso | |
| 5,150,651 | A | 9/1992 | Flores | |
| 5,202,729 | A | 4/1993 | Miyamoto et al. | |
| RE34,384 | E | 9/1993 | Ishiguro et al. | |
| 5,321,473 | A | 6/1994 | Azami | |
| 5,369,477 | A | 11/1994 | Foote et al. | |
| 5,404,216 | A | 4/1995 | Numagami et al. | |
| 5,455,665 | A | 10/1995 | Baba et al. | |
| 5,475,467 | A | 12/1995 | Watanabe et al. | |
| 5,488,462 | A | 1/1996 | Ishikawa et al. | |
| 5,502,547 | A | 3/1996 | Shirai | |
| 5,550,617 | A | 8/1996 | Odagawa et al. | |
| 5,585,895 | A | 12/1996 | Yashiro et al. | |
| 5,655,178 | A | 8/1997 | Ishikawa et al. | |
| 5,671,673 | A | 9/1997 | Boose et al. | |
| 5,697,021 | A | 12/1997 | Watanabe et al. | |
| 5,697,022 | A | 12/1997 | Matsuda et al. | |
| 5,701,558 | A | 12/1997 | Kojima | |
| 5,758,230 | A | 5/1998 | Nakaue et al. | |
| 5,774,765 | A | 6/1998 | Hirota et al. | |
| 5,778,282 | A | 7/1998 | Nagashima | |
| 5,805,958 | A | 9/1998 | Fisk | |
| 5,805,965 | A | 9/1998 | Tsuda et al. | |
| 5,809,374 | A | 9/1998 | Tsuda et al. | |
| 5,870,651 | A | 2/1999 | Shimanda | |
| 5,875,378 | A | 2/1999 | Campbell et al. | |
| 5,895,144 | A | 4/1999 | Nishimura | |
| 5,895,151 | A | 4/1999 | Kinoshita et al. | |
| 5,937,237 | A | 8/1999 | Nonaka et al. | |
| 5,946,530 | A | 8/1999 | Tsuji et al. | |
| 5,987,277 | A | 11/1999 | Okabe | |
| 5,995,774 | A | 11/1999 | Applegate et al. | |
| 6,009,285 | A | 12/1999 | Barry et al. | |
| 6,021,297 | A | 2/2000 | Campbell et al. | |
| 6,035,158 | A | 3/2000 | Asakura et al. | |
| 6,049,689 | A | 4/2000 | Ishii et al. | |
| 6,070,027 | A | 5/2000 | Kawai et al. | |
| 6,071,660 | A | 6/2000 | Black et al. | |
| 6,078,763 | A | 6/2000 | Hoshi | |
| 6,078,771 | A | 6/2000 | Buchanan et al. | |
| 6,094,550 | A | 7/2000 | Kido et al. | |
| 6,104,894 | A | 8/2000 | Sato et al. | |
| 6,115,565 | A | 9/2000 | Noda | |
| 6,178,301 | B1 | 1/2001 | Kojima et al. | |
| 6,181,897 | B1 | 1/2001 | Kawai | |
| 6,185,392 | B1 | 2/2001 | Hoshi | |
| 6,195,515 | B1 | 2/2001 | Fujita et al. | |
| 6,205,304 | B1 | 3/2001 | Kawaguchi | |
| 6,212,343 | B1 | 4/2001 | Hosokawa et al. | |
| 6,341,206 | B1 | 1/2002 | Yamaguchi et al. | |
| 6,471,773 | B1 | 10/2002 | Atkins | |
| 6,487,383 | B2 | 11/2002 | Buchanan et al. | |
| 6,553,195 | B2 | 4/2003 | Korfhage et al. | |
| 6,574,444 | B2 | 6/2003 | Uehara et al. | |
| 6,629,496 | B1 | 10/2003 | Boose et al. | |
| 6,643,481 | B2 | 11/2003 | Higeta et al. | |
| 6,671,473 | B2 * | 12/2003 | Miyabe | 399/104 |
| 6,690,900 | B2 | 2/2004 | Dougherty et al. | |
| 6,697,594 | B1 | 2/2004 | Murphy et al. | |
| 6,832,551 | B2 | 12/2004 | Jendroska et al. | |
| 6,842,595 | B1 | 1/2005 | McIver et al. | |
| 6,901,228 | B2 | 5/2005 | Kamimura et al. | |
| 7,062,195 | B2 | 6/2006 | Kurihara et al. | |
| 7,076,185 | B2 * | 7/2006 | Okamoto | 399/103 |
| 7,177,565 | B1 | 2/2007 | Miller | |
| 2002/0090226 | A1 | 7/2002 | Sato et al. | |
| 2003/0235438 | A1 | 12/2003 | Tatsumi | |
| 2004/0131839 | A1 | 7/2004 | Eagle | |
| 2005/0013890 | A1 | 1/2005 | Chapman et al. | |
| 2005/0158070 | A1 | 7/2005 | Ishii | |
| 2007/0034099 | A1 | 2/2007 | Gayne | |
| 2007/0034100 | A1 | 2/2007 | Gayne | |
| 2007/0134020 | A1 * | 6/2007 | Lee et al. | 399/103 |
| 2007/0140729 | A1 * | 6/2007 | Carter et al. | 399/103 |

OTHER PUBLICATIONS

Prosecution file history of co-pending U.S. Appl. No. 11/959,058 including the Non-Final Office Action dated Mar. 30, 2011 and the response filed Jun. 29, 2011.

* cited by examiner

UPPER SEAL FOR INHIBITING DOCTOR BLADE TONER LEAKAGE

CROSS REFERENCES TO RELATED APPLICATIONS

This patent application is related to the U.S. patent application Ser. No. 11/959,058, filed even date herewith, entitled "Developer Roll Lip Seal" and assigned to the assignee of the present application. The lip seal disclosed in this related application may be used in combination with the upper seal disclosed herein but it may also be used independently of this upper seal.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to a doctor blade assembly, and more specifically relates to an upper seal for a doctor blade assembly which inhibits toner leakage generally in the area of the developer housing and the doctor blade bracket assembly.

2. Description of the Related Art

Laser printers utilize a light beam which is focused to expose a discrete portion of a photoreceptive or image transfer drum in a further attempt to attract printing toner to these discrete portions. One component of a laser printer is the photoreceptive drum assembly. This photoreceptive drum assembly is made out of highly photoconductive material that is discharged by light photons typically embodied by a laser. Initially, the drum is given a charge by a charge roller. As the photoreceptive drum revolves, the printer shines a laser beam across the surface to discharge certain points. In this way, the laser "draws" the letters and images to be printed as a pattern of electrical charges—an electrostatic latent image. The system can also work with either a more positively charged electrostatic latent image on more negatively charged background or a more negative charged electrostatic latent image on a more positively charge background.

The printer's laser or laser scanning assembly draws the image to be printed on the photoreceptive drum. The traditional laser scanning assembly may include a laser, a movable mirror and a lens. The laser receives the image data defined by pixels that make up the text and images one horizontal line at a time. As the beam moves across the drum, the laser emits a pulse of light for every pixel to be printed. Typically, the laser doesn't actually move the beam. Instead, the laser reflects the light beam off of a movable mirror. As the mirror moves, the light beam passes through a series of lenses. This system compensates for the image distortion caused by the varying distance between the mirror and points along the drum. The laser assembly moves in one plane horizontally as the photoreceptor drum continuously rotates so the laser assembly can draw the next line. A print controller synchronizes this activity. The process of forming the light image on the photoreceptive drum discharges those areas where the image is formed.

When the toner becomes electrostatically charged, the toner is attracted to exposed portions of the image transfer drum. After the data image pattern is set, charged toner is supplied to the photoconductive drum. Because of the charge differential, the toner is attracted to and clings to the discharged areas of the drum, but not to the similarly charged "background" portions of the photoconductive drum. Toner is an electrostatically charged powder with two main ingredients, pigment and plastic. The pigment provides the coloring, such as black in a monochrome printer to form text and images. This pigment is blended with plastic particles, so the toner will melt when passing through the heat of a fuser assembly. The toner is stored in the toner cartridge housing, a small container built into a removable casing. The printer gathers the toner from a sump within the housing and supplies it to a developer unit using paddles and transfer rollers. The developer roll is a charged rotating roller, typically with a conductive metal shaft and an polymeric conductive coating, which receives toner from a toner adder roll position adjacent the developer roll. Due to electrical charge and mechanical scrubbing, the developer roll collects toner particles from the toner adder roll. A doctor blade assembly engages the developer roll to provide a consistent coating of toner along the length and surface of developer roll, by scraping or "doctoring" excess toner from the developer roll. The doctor blade may also induce a charge on the toner. In turn, this provides a consistent supply of toner to the photoconductive drum. When the coating of toner on the developer roll is inconsistent, too thick, too thin or bare, coating of the photoconductive drum is inconsistent and the level of darkness of the printed image may vary unintentionally, which is considered a print defect.

The electrostatic image on the photoconductive drum is charged such that the toner particles move from the developer roll onto the latent image on photoconductive drum. With the image data toner pattern on the photoconductive drum, the drum engages a sheet of paper or media moving adjacent thereto. The paper or other media is driven by a transport belt, which is oppositely charged to the toner causing it to transfer to the paper or other media. This charge is stronger than the charge of the electrostatic image, so the paper can pull the toner powder away from the surface of the photoconductive drum. When a medium, printing paper, passes beneath the rotating photoconductive drum, the toner is transferred to the medium. Since it is moving at the same speed as the drum, the paper picks up the image pattern exactly. To keep the paper from clinging to the drum, it can be discharged immediately after picking up the toner.

One problem with existing doctor blade assemblies is that of providing a consistent seal generally around the location where doctor blade assembly and the developer housing meet due to the tolerances and stiffness of the seal utilized in this location. Additionally, as shown in the prior art device depicted in FIG. 7, the corner area where the bracket and doctor blade meet also provides a leakage path. The paddles that move the toner from the sump to the developing components of the cartridge cause a cyclical internal toner pressure in the cartridge. The operational toner pressure as well as vibration and drop testing has demonstrated this corner location to be a frequent toner leak path, especially in higher volume developer housings. The leakage occurs in the area of the blade and bracket corner due to deformation of the upper portion of the j-seal when the bracket assembly is disposed thereon.

It would be desirable to inhibit toner leakage in the area of the corner of the developer housing as well as the corner where the bracket and blade meet without adding additional parts or increasing expense through additional components to seal this area.

SUMMARY OF THE INVENTION

A seal, for inhibiting toner leakage from a toner cartridge having a doctor blade assembly having a doctor blade seal and a developer roll, comprises an upper seat portion for sealably engaging said doctor blade assembly and a leg for sealably engaging said developer roll. The upper seat portion comprises an upper seat inner seal wall and an upper seat outer seal wall spaced apart from said upper seat inner seal wall a preselected distance and defining a gap therebetween for closely receiving a portion of the doctor blade seal between said upper seat inner and outer seal walls. In a further embodiment, the upper seat inner seal wall is disposed at a substantially acute angle respect to said upper seat outer seal wall and in another embodiment, the upper seat outer seal wall comprises an upper tapered horizontal edge and a curved vertical edge.

A seal assembly for inhibiting toner leakage comprises a j-seal positioned to be received by a developer housing. The j-seal has an upper seat portion forming a doctor blade seal and a leg for slidably sealing a developer roll. The upper seat portion has an upper seat inner seal wall and an upper seat outer seal wall spaced apart a preselected distance and defining a gap. The doctor blade seal engages the upper seat inner and outer seals. A doctor blade bracket assembly is disposed adjacent the j-seal and the doctor blade seal, the doctor blade seal further having a tongue disposed within the gap defined between the upper seat inner and outer seal walls, the doctor blade seal sealably engaging the doctor blade bracket assembly. The seal assembly further comprises a curved upper edge of the upper seat outer seal. The seal assembly further comprises having the upper seat inner seal angled to receive an angled surface of the doctor blade seal. The doctor blade bracket assembly compresses the doctor blade seal within the upper seat portion of the j-seal. The doctor blade bracket assembly engages an upper curved or tapered edge of the upper outer seat seal to provide an inwardly directed component force on the upper seat outer seat. The doctor blade seal further comprises an edge rib on an end surface.

The seal assembly for inhibiting toner leak comprises a j-seal having a lower j-shaped portion for receiving and slidably sealing a roll and an upper seat portion, the upper seat portion has a first upper seat seal, a second upper seat seal and a gap defined between the first upper seat seal and the second upper seat seal, a doctor blade seal has a tongue disposed at ends of the doctor blade seal, the tongue positioned between the first upper seat seal and the second upper seat seal and interlocking the j-seal and the doctor blade seal, the doctor blade seal sealing along three edges of the j-seal, a doctor blade assembly disposed on the doctor blade seal so that the doctor blade engages the first upper seat seal, the second upper seat seal, the upper seat portion of said j-seal and the doctor blade seal. The doctor blade assembly includes at least one bracket and a doctor blade. The first upper seat seal is an upper seat inner seal. The upper seat inner seal is disposed at an angle from a front surface of the j-seal. The second upper seat seal is an upper seat outer seal. An upper edge of the upper seat outer seal is curved tapered to provide an inwardly directed component force on the second upper seat seal to improve sealing. The seal assembly further comprises a recess defined by at least two surfaces of the doctor blade seal, the recess receiving the upper seat inner seal of the j-seal.

A seal assembly for preventing toner leakage comprises a first j-seal having a first upper seat portion, a second j-seal having a second upper seat portion, a doctor blade seal extending between the first j-seal and the second j-seal, ends of the doctor blade seal disposed within the respective first upper seat portion and the second upper seat portion, each of the first and second upper seat portions having a upper seat inner seal and an upper seat outer seal, a gap defined between each of the upper seat inner and outer seals, the doctor blade seal having a tongue disposed within each respective gap interlocking the first and second j-seals with the doctor blade seal, the tongue sealing within a corner defined by a doctor blade and the doctor blade bracket. The seal assembly further comprises an upper tapered edge on each of the upper seat outer seal. The seal assembly further comprises the upper seat inner seal is disposed at an acute with respect to the upper seat outer seal. The seal assembly further comprises a doctor blade assembly. The doctor blade assembly captures the doctor blade seal within the first and second seat portions of the j-seals.

BRIEF DESCRIPTION OF THE DRAWINGS

The aforementioned features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
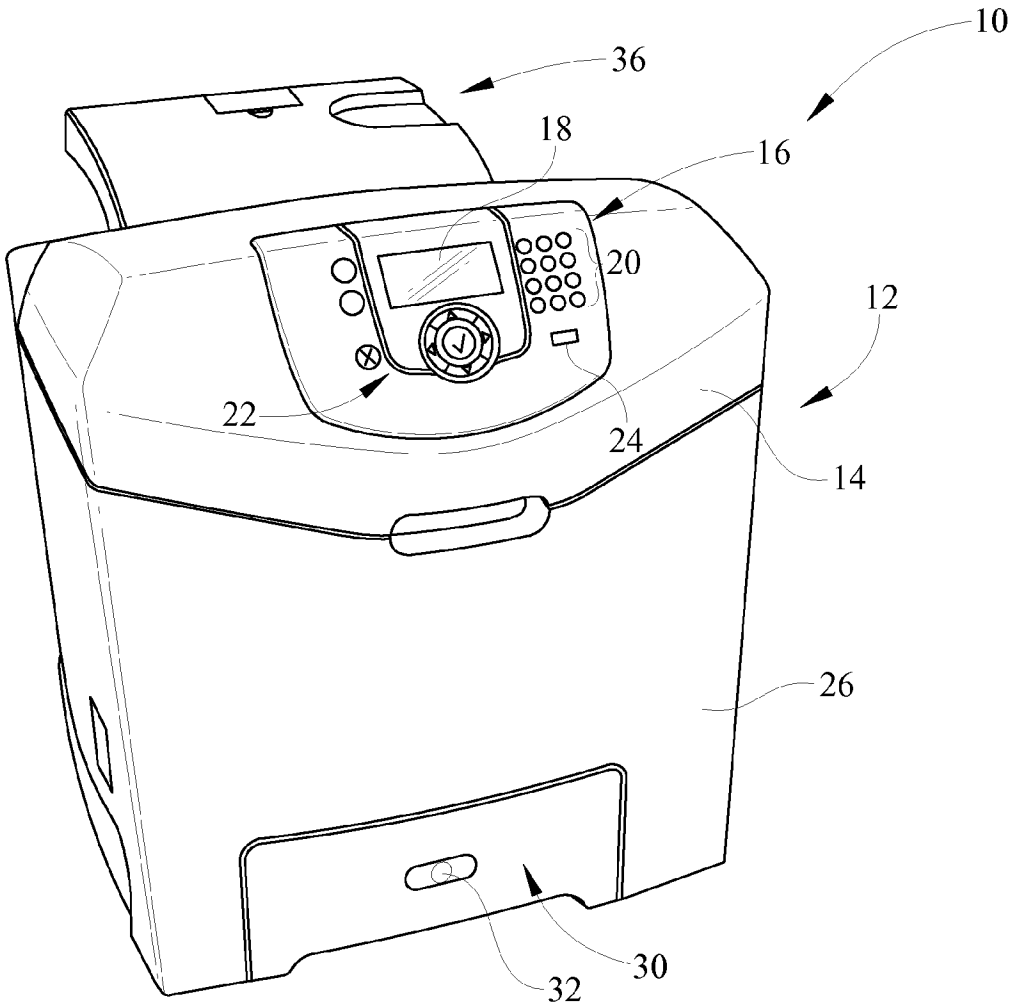
FIG. 1 depicts an exemplary electrophotographic printer.

The following description and drawings illustrate embodiments of the invention sufficiently to enable those skilled in the art to practice it. It is to be understood that the invention is not limited in its application to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the appended claims and all available equivalents. The following description is, therefore, not to be taken in a limited sense, and the scope of the present invention as defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate two or more functions such as scanning, copying, printing, and faxing capabilities in one device. Such printing devices may utilize ink jet, dot matrix, dye sublimation, laser, and any other suitable print formats. The term button as used herein means any component, whether a physical component or graphic user interface icon, that is engaged to initiate output. The term media and paper may be used interchangeably herein and may include plain paper, glossy photo paper, coated paper, card stock, index cards, labels, envelopes, transparency, MYLAR, fabric, or other printable materials. The term operations panel, as used herein, means an interactive display allowing for menu display, menu selections, image viewing, editing of images, correction of error conditions and other operations and control functions. The term peripheral may include a single function or multi-function, or all-in-one, device which may be connected to a host computer, network connected or may be a stand-alone, which is a device which may function independently of any host computer.

The exemplary embodiments described herein provide a seal assembly which inhibits toner leakage from around the area of the developer housing and the doctor blade assembly at ends of the developer roll.

Figure 2:
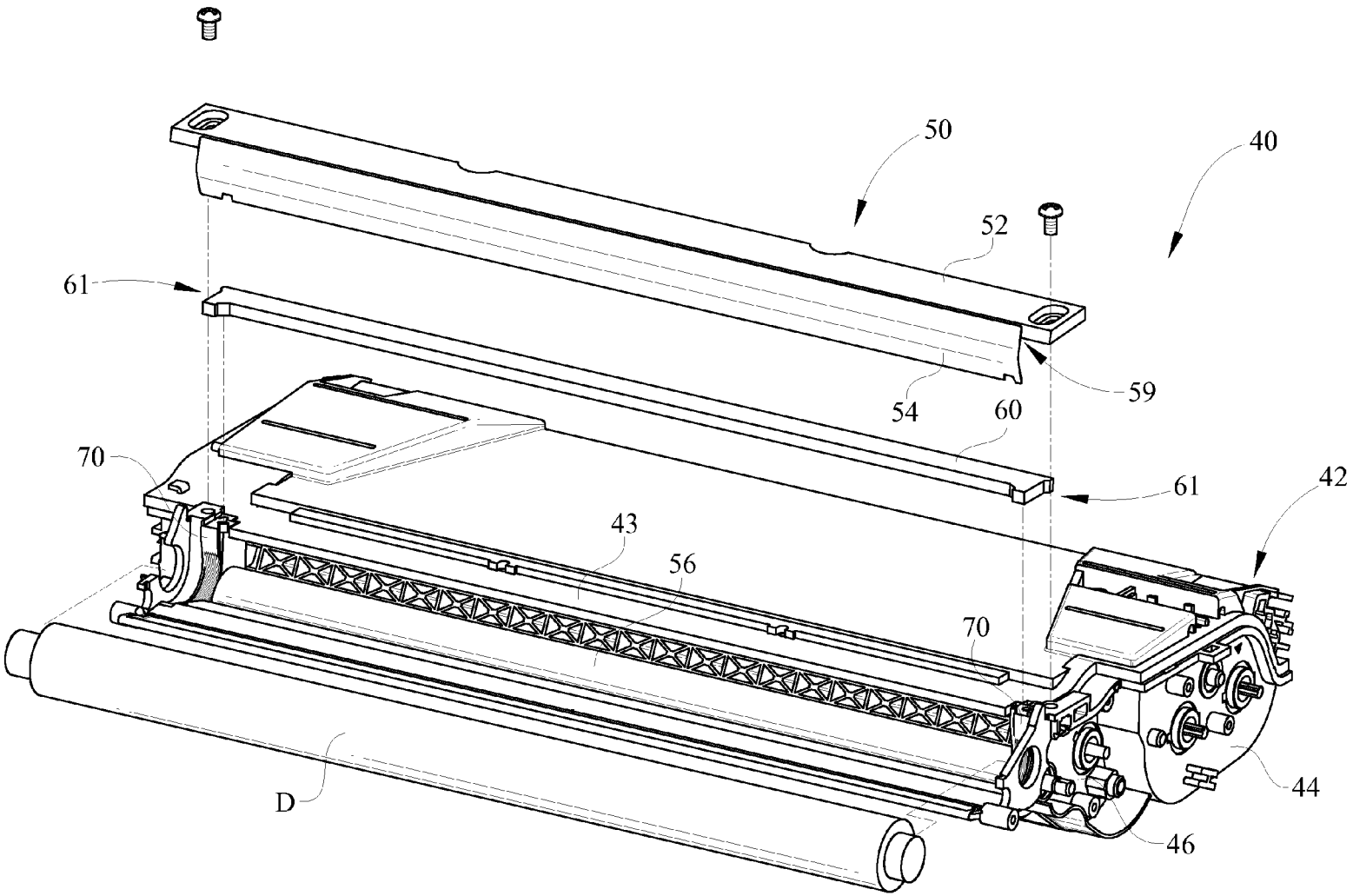
FIG. 2 depicts a partially exploded perspective view of a developer assembly.

Referring now to FIG. 1, a perspective view of a peripheral 10 having a laser printing mechanism is depicted in perspective view. Although, the peripheral device is depicted, one skilled in the art should realize that the present design may alternatively be used with an all-in-one device, copier, fax, stand-along device or the like having an electrophotographic (laser) print engine. The exemplary peripheral embodied by the laser printer 10, comprises a housing 12 including a primary access door 14 positioned on the top-front of the housing 12. The housing 12 generally comprises a front surface, first and second side surfaces, a rear surface (not shown) and a bottom surface to enclose the laser printer operating mechanisms. On the front of the housing 12, the primary access door 14 is pivotally mounted to allow opening and access for installation or removal of a developer assembly 40 (FIG. 2). The front panel of the primary access door 14 comprises an operations panel 16 which includes a display 18, an alpha numeric keypad 20, a plurality of selection buttons 22, as well as a flash memory slot 24. The operations panel 16 is in electronic communication with a controller (not shown), which may be embodied by one or more micro-processors, in order to operate the laser printer 10. Beneath the primary access door 14 is a secondary access door 26 which allows access to the developers or toner cartridges. The printer 10 may operate in both monochrome and color. For example, three additional toner cartridges may be utilized to provide the color printing comprising the toner colors cyan, yellow or magenta, although other colors may be utilized.

Beneath the access doors 14, 26 is an input tray access door 30. When the input tray access door 30 is opened with a release 32, an input tray (not shown) is accessible to load the printer 10 with media. The input tray may hold a stack of media for printing and further defines a starting point of a media feedpath (not shown) extending from the media input tray to a media output tray 36. The media feedpath may be a duplex feedpath or a simplex feedpath. The media output tray 36 is located on top of the housing 12 and generally extends rearwardly to store printed media processed by the laser printer 10.

Referring now to FIG. 2, a developer assembly 40 is depicted in perspective view. The developer assembly 40 comprises a housing 42, formed of a first housing portion 44 and a second housing portion 46. Along at least one side of the housing 42 is a lid 43. Within the first housing portion 44, a plurality of toner is stored, and at least one paddle is located therein on a rotating shaft to move the toner from the first housing portion 44 toward the second housing portion 46. A toner adder roll 56 is located within or adjacent to the second housing portion 46, and receives toner there from. The toner adder roll 56 coats the developer roll D with toner, which is scraped or "doctored" by the doctor blade 54 to form an even layer of toner on the developer roll D, and in turn supplies toner to the imaging or photoreceptive drum. The seal assembly of the present embodiment inhibits leakage of toner in between the developer housing 46 and the corner 59 formed by the doctor blade bracket 52 and the doctor blade 54 when it is dropped and also during operation when the developer unit 42 vibrates and creates internal pressures.

The developer assembly 40 comprises seals 70 at ends of the developer roll D. The developer roll D is exploded for clarity, so that the seals 70 may be seen. The seals 70 are substantially j-shaped to receive the developer roll, although other curvilinear shapes may be utilized. The upper portion of the j-seal 70 is slightly curved to substantially match the deflected shape of a blade 54. The lower portion of the j-seal 70 is curved to receive the developer roll D. Disposed above the seals 70 is a doctor blade seal 60, which extends in a length that is parallel to the axial dimension of the developer roll. Also disposed above the seals 70 is a doctor blade bracket assembly 50 comprising at least one first bracket 52 and a doctor blade 54. Like the doctor blade seal 60, the doctor blade bracket assembly 50 also extends in a direction which is substantially parallel to the axial dimension of both the toner adder roll 56 and developer roll D. The doctor blade seal 60 is captured between the doctor blade bracket assembly 50 and the j-seal 70 or the lid 43. The doctor blade 54 engages a developer roll to scrape excess toner from the surface of the developer roll, which provides a consistent level of toner to the imaging or photoreceptive drum of the printer 10. The doctor blade seal 60 is seated on the j-seals 70 to inhibit leakage of toner near ends of the developer roll and between the lid 43 and the developer housing 42. The doctor blade bracket assembly 50 compresses the doctor blade seal 60 to improve sealing in this area.

Figure 3:
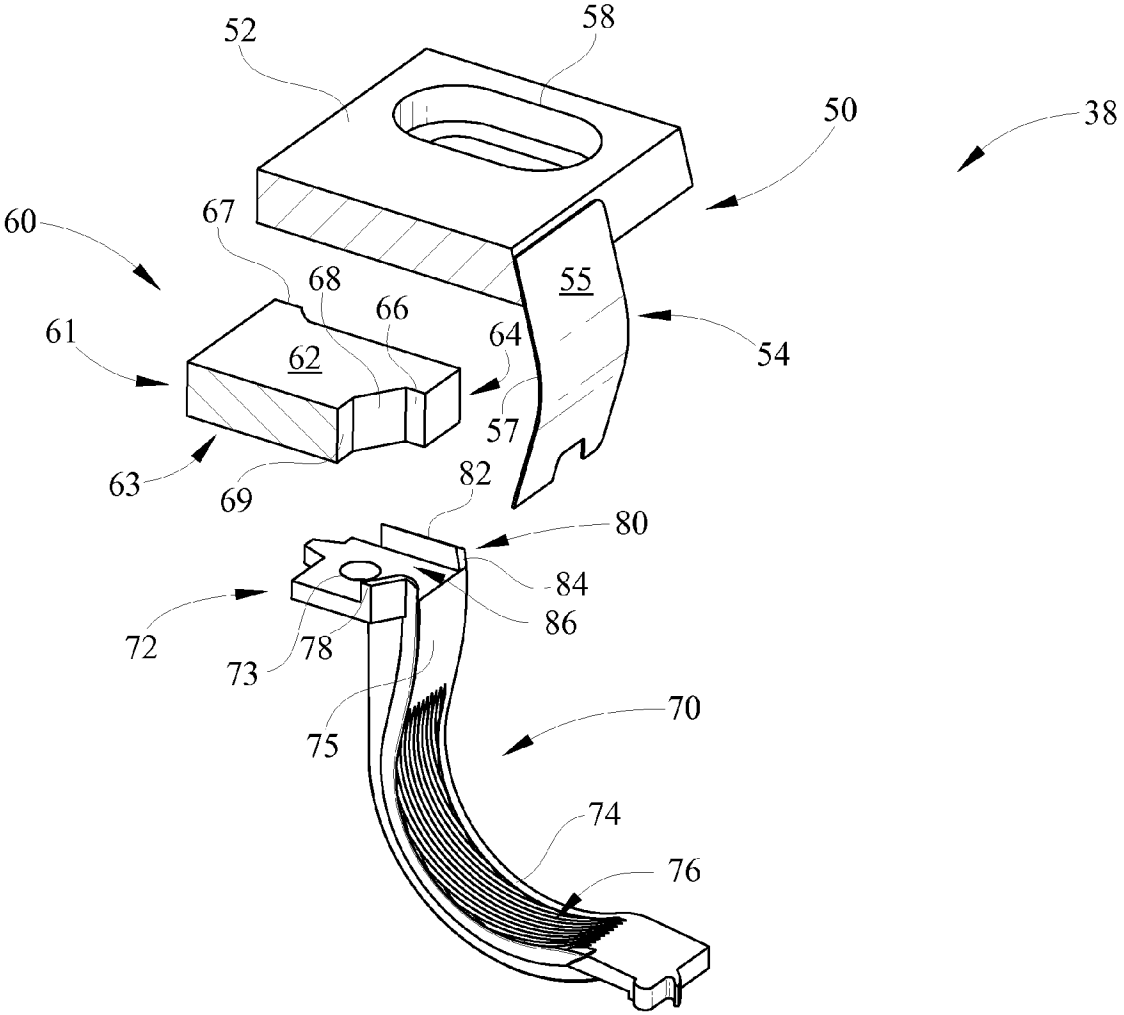
FIG. 3 depicts an exploded perspective view of a developer seal assembly from a first angle.

Referring now to FIG. 3, an exploded perspective view of the seal assembly 38 is depicted. The doctor blade bracket assembly 50 and the doctor blade seal 60 are cut in section for purpose of clarity. As previously indicated, the doctor blade bracket assembly 50 is disposed above the doctor blade seal 60 which is positioned above the j-seal 70. The doctor blade bracket assembly 50 comprises a bracket 52 and a blade 54 connected to the bracket 52. According to the exemplary embodiment, the blade 54 is welded to the bracket 52. However the bracket 52 may be connected to the blade 54 by a fixative such as epoxy, cement, glue or the like. In a further alternative, the blade 54 may be connected to the bracket 52 by a fastener or, the blade 54 may be captured or sandwiched between first and second bracket members. The bracket 52 includes an aperture 58 for connection of the doctor blade bracket assembly 50 to the housing 42. The aperture 58 is oval in shape so as to provide an adjustment for the blade 54 toward or away from the developer roll D. The bracket 52 is generally a stiff material such as steel and rectangular in shape extending from one side of the housing 42 to an opposed side of the housing 42. The bottom surface of the bracket 52 is generally smooth so as to engage the upper surface of the doctor blade seal 60.

The blade 54 extends from the bracket 52 toward a peripheral surface of the developer roll D in order to scrape excess toner from the outer surface of the developer roll D. The blade 54 is generally rectangular in shape having a long or widthwise dimension substantially parallel to the direction of the axial dimension of the developer roll. The blade 54 includes a front surface 55 and a rear surface 57. The blade 54 is straight in its natural state, but in order to provide a "doctoring" force on the developer roll D has a slight curvature due to interference with the developer roll D upon installation. In addition, the blade 54 has notches near ends of the blade for removing all toner from the ends of the developer roll D where printing does not occur. The blade 54 may also receive an electrical potential in order to charge the developer roll D with a desired polarity during operation. The lower surface of the bracket 52 engages an upper surface 62 of the doctor blade seal 60, so as to capture the seal 60 between the doctor blade assembly 50 and the j-seal 70. According to the exemplary embodiment, the blade 54 may be formed of phosphor bronze to provide the desired elasticity and electrical conductivity or alternatively may be formed of a hardened stainless steel to provide a desired elasticity and also withstand corrosion which might damage the developer roll. Other materials may also be utilized.

An end portion 61 of the doctor blade seal 60 is shown above one of the j-seals 70. The doctor blade seal 60 has first and second ends 61 (FIG. 2). As previously described, the doctor blade seal 60 extends between the ends 61 in a direction generally parallel to the axial dimension of the developer roll and the toner adder roll 56. The doctor blade seal 60 is formed of a foam material to act as a deformable seal between the bracket assembly 50 and the j-seal 70 or the lid 43, as well as around the housing 42 adjacent the j-seal 70 and between the bracket 52 and blade 54. The ends 61 are positioned on an upper seat surface 73 of the j-seal 70. The portion of the doctor blade seal 60 between the ends 61 is supported by the lid 43 of the housing 42 (FIG. 2).

The doctor blade seal 60 has an upper surface 62, a lower surface 63 and a plurality of sides extending between the upper and lower surfaces 62,63. Along the front of the doctor blade seal 60, toward the doctor blade 54, a tongue 64 is integrally formed with and extending from the doctor blade seal end 61. On an outer side of the tongue 64 is an end surface 65 (FIG. 4) of the doctor blade seal 60. On the opposite surface of the tongue 64 near the blade 54, is a tongue extending surface 66. Angled from the tongue extending surface 66 is an angled or tapered surface 68. The angled surface 68 joins the tongue extending surface 66 and a front seal surface 69, which extends the distance of the doctor blade seal 60 to the opposite end 61 (not shown) of the doctor blade seal 60. Therefore, the tongue 64 generally extends from the angled surface 68 in a direction substantially perpendicular to the front seal surface 69. In combination, the surfaces 69, 68, 66 define a recess wherein an upper seat inner seal wall 78 of the J-seal 70 is received. As previously indicated, the doctor blade seal 60 extends in a width-wise direction, which corresponds to the width of a media sheet, and perpendicular to the media feed path direction to an opposite end of seal 60 (not shown).

Beneath the doctor blade seal 60, the j-seal 70 comprises an upper seat portion 72, and a developer roll leg 74, which is substantially j-shaped and depending from the upper seat portion 72. The j-seal 70 may be formed in a molding process, such as injection molding, compression molding, or other known processes for forming a plastic, such as a thermoplastic rubber having the trade name SANTOPRENE. The leg 74 has a front surface 75 comprising a plurality of grooves 76, which provide several functions. The grooves 76 "snowplow" the toner on the developer roll and capture toner between the grooves to inhibit leakage. The grooves 76 also direct the toner toward a storage area via rotation of the developer roll D (FIG. 2). The grooves 76 are disposed at an angle, which may be from about zero to about forty-five degrees from the sidewall of the leg 74.

The upper seat portion 72 comprises a seating surface 73, an upper seat inner seal or seal wall 78 and an upper seat outer seal or seal wall 80. A gap 86 is disposed between the upper seat inner seal 78 and the upper seat outer seal 80, wherein the tongue 64 may be closely received within the upper seat portion 72 to interlock the j-seal 70 and the doctor blade seal 60. The seating surface 73 also comprises an aperture made for receiving an alignment pin for proper positing of the j-seal 70 to the housing 42.

The upper seat inner seal wall 78 extends upwardly from the upper seat surface 73. The upper seat inner seal 78 is disposed at an acute angle with respect to the outer seal 80 which corresponds to that of the angled surface 68, so that the upper seat inner seal 78 and angled surface 68 engage one another in sealing fashion. Further, the upper seat inner seal 78 is received within the recess defined by the surfaces 66, 68, 69.

Figure 4:
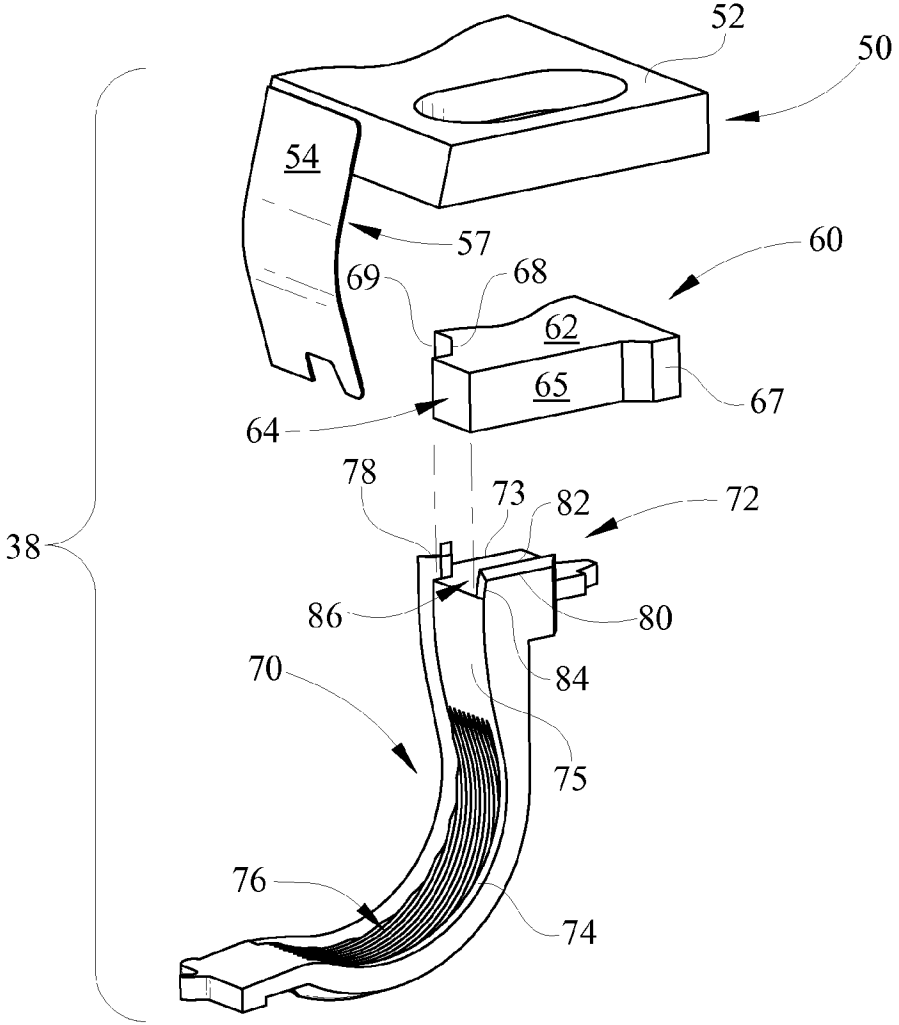
FIG. 4 depicts an exploded perspective view of the developer seal from a second angle.

Referring additionally now to FIG. 4, the sealing assembly 38 is depicted from an opposite side as FIG. 3 and in an exploded perspective view. The upper seat outer seal 80 is depicted extending upwardly above the upper seat surface 73 and from a front edge 75 of the j-seal 70 rearwardly. The upper seat outer seal wall 80 comprises an upper tapered horizontal edge 82 and a curved vertical edge 84. When the bracket assembly 50 is located on the doctor blade seal 60, the seal 60 compresses within the j-seal upper seat 72. Due to this compression, the lower surface of the bracket 52 engages the tapered horizontal edge 82. Since the upper edge 82 of the upper outer seat seal 80 is tapered, the downward force on the edge 82, caused by the bracket assembly 50, results in an inwardly directed component force which pushes the upper seat outer seal 80 inwardly against the doctor blade seal 60. This causes increased sealing performance along the interface between the j-seal 70 and the end surface 65 of the doctor blade seal 60. The curved vertical edge 84 matches the profile of the blade 54 to engage the rear surface of the blade 54.

Also extending from the end surface 65 of seal 60 is an edge rib 67. The rib 67 is deformed so as to be positioned over an edge of the housing wherein the j-seal 70 is seated. Since the rib 67 extends outwardly from the end surface 65, the upper seat outer seal 80 does not extend rearwardly the entire length of the seating surface 73. Accordingly, space is provided for the edge rib 67 to extend outwardly beyond the outer seal wall 80.

Figure 5:
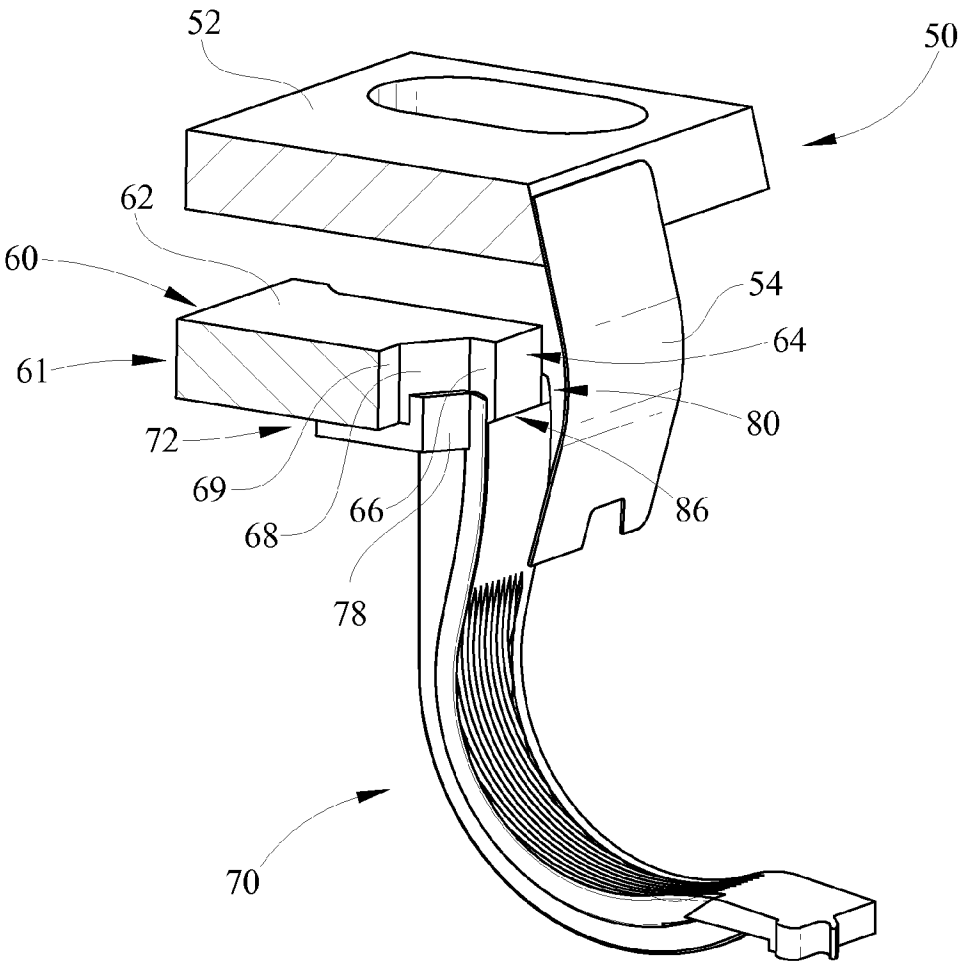
FIG. 5 depicts one end of a partially assembled toner seal assembly.

Referring now to FIG. 5, a perspective view of the assembly 38 is depicted with the doctor blade seal 60 positioned in the upper seat portion 72. The upper seat inner seal 78 is disposed within the recess defined by surfaces 66, 68, 69. Further, the angled surface 68 is engaging the upper seat inner seal wall 78. When the bracket assembly 50 is lowered on the doctor blade seal 60, the doctor blade seal 60 is compressed so that the seal surfaces 66, 68, 69 expand to engage inner seal wall 78. The tongue 64 of the doctor blade seal 60 is extending into and through the j-seal gap 86.

Figure 6:
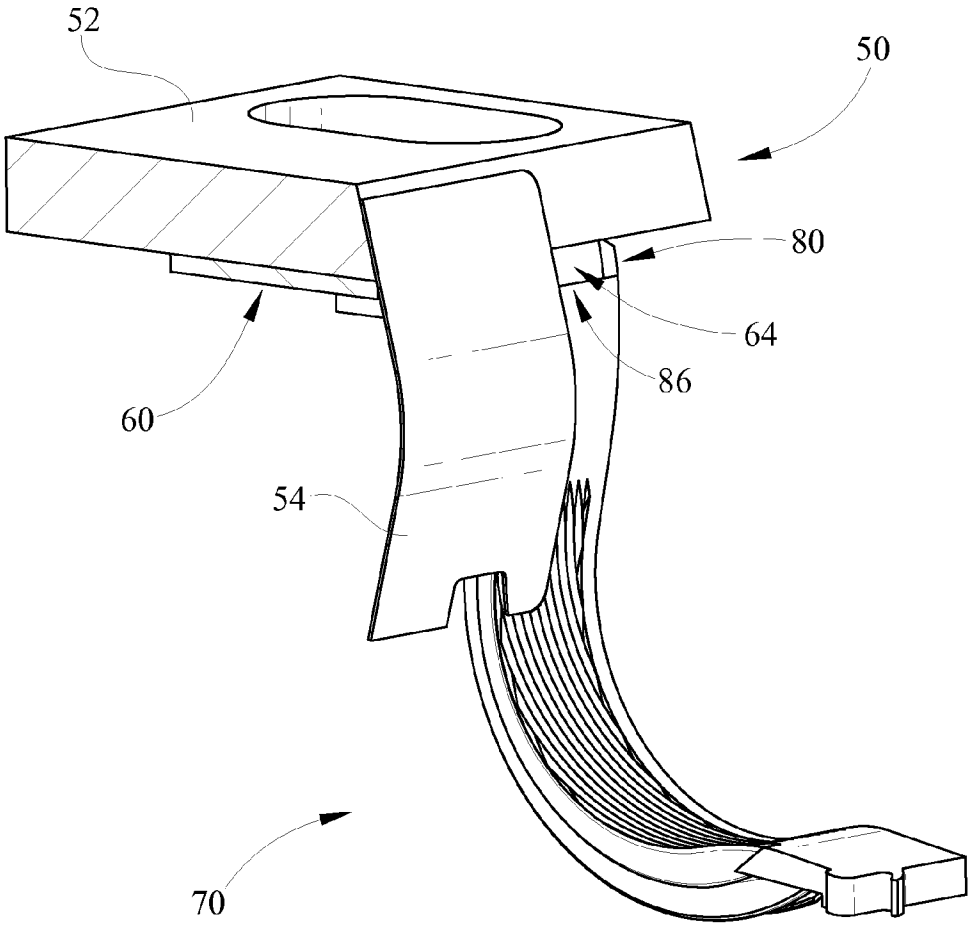
FIG. 6 depicts one end of the toner seal assembly.
Figure 7:
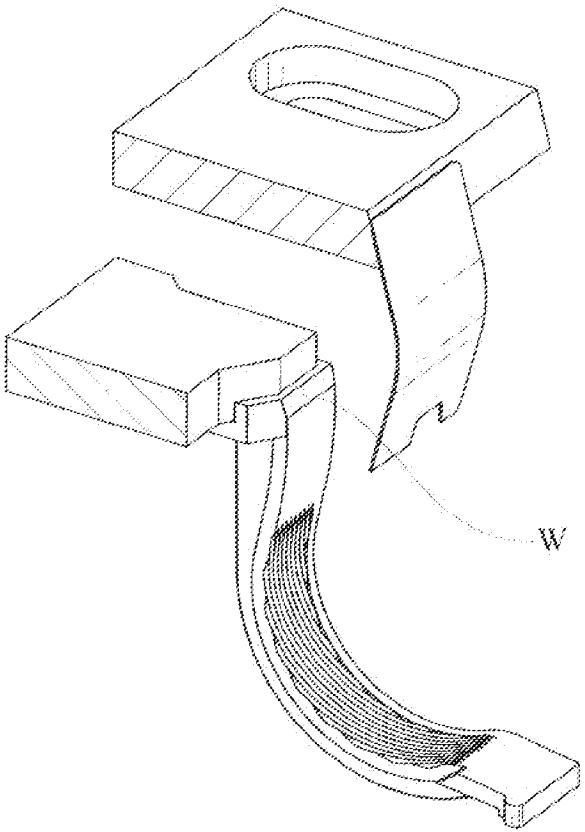
FIG. 7 Prior Art
FIG. 7 depicts a prior art seal assembly which allows some leakage around the housing, j-seal and blade assembly.

Referring now to FIG. 6, the bracket assembly 50 is positioned on the doctor blade seal 60. The down force of the assembly 50 which is tightened against the housing 42 (FIG. 2) compresses the doctor blade seal 60. The compressing of the doctor blade seal 60 also forces the doctor blade seal 60 into the corner defined at the junction between the doctor blade 54 and the bracket 52 inhibiting leakage from that path. Additionally, the bracket assembly 50 engages the horizontal edge 82, providing an inwardly directed force on the upper seat outer seal 80 to improve sealing along the interface between the doctor blade seal 60 and the j-seal 70.

The foregoing description of the various embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A seal for inhibiting toner leakage from a toner cartridge having a doctor blade assembly having a doctor blade seal and a developer roll, comprising:

an upper seat portion for sealably engaging said doctor blade assembly, said upper seat portion comprising:

an upper seat inner seal wall; and an upper seat outer seal wall spaced apart from said upper seat inner seal wall a preselected distance and defining a gap therebetween for closely receiving a portion of the doctor blade seal between said upper seat inner and outer seal walls;

and, a leg for sealably engaging said developer roll.

2. The seal of claim 1 wherein said upper seat inner seal wall is disposed at a substantially acute angle respect to said upper seat outer seal wall.

3. The seal of claim 1 wherein said upper seat outer seal wall comprises an upper tapered horizontal edge and a curved vertical edge.

4. A seal assembly for inhibiting toner leakage from a toner cartridge, comprising:

a j-seal positioned to be received by a developer housing;

said j-seal having an upper seat portion for a doctor blade seal and a leg for slidably sealing a developer roll;

said upper seat portion having an upper seat inner seal wall and an upper seat outer seal wall spaced apart a preselected distance and defining a gap therebetween;

a doctor blade bracket assembly having a doctor blade seal disposed adjacent said j-seal and said upper seat portion; and said doctor blade seal having a tongue disposed within said gap defined between said upper seat inner and outer seal walls for sealably engaging said doctor blade bracket assembly.

5. The seal assembly claim 4 further comprising a tapered upper edge of said upper seat outer seal wall.

6. The seal assembly of claim 4 wherein said upper seat inner seal wall is angled to receive an angled surface of said doctor blade seal.

7. The seal assembly of claim 4 comprising said doctor blade bracket assembly compressing said doctor blade seal within said upper seat portion of said j-seal.

8. The seal assembly of claim 7, said doctor blade bracket assembly engaging an upper tapered edge of said upper seat outer seal wall and providing an inwardly directed component force on said upper seat outer seal wall for sealing engagement with said doctor blade seal.

9. The seal assembly of claim 4, said doctor blade seal further comprising an edge rib on an end surface.

10. A seal assembly for inhibiting toner leak in a toner cartridge, comprising:

a j-seal having a lower j-shaped portion for sliding sealing a roll and an upper seat portion;

said upper seat portion having a first upper seat seal, a second upper seat seal and a gap defined between said first and second upper seat seals;

a doctor blade seal having a tongue disposed at an end of said doctor blade seal, said tongue positioned between said first and second upper seat seals and interlocking said j-seal and said doctor blade seal;

said doctor blade seal sealing along three edges of said j-seal;

a doctor blade assembly disposed on said doctor blade seal so that said doctor blade assembly engages said first upper seat seal, said second upper seat seal, said upper seat portion of said j-seal and said doctor blade seal.

11. The seal assembly of claim 10 wherein said doctor blade assembly includes at least one bracket and a doctor blade.

12. The seal assembly of claim 10 wherein said first upper seat seal is an upper seat inner seal wall.

13. The seal assembly of claim 12 wherein said upper seat inner seal wall is disposed at an acute angle with respect to a front surface of said j-seal.

14. The seal assembly of claim 10 wherein said second upper seat seal is an upper seat outer seal wall.

15. The seal assembly of claim 14 wherein an upper edge of said upper seat outer seal wall is tapered.

16. The seal assembly of claim 10 further comprising a recess defined by at least two surfaces of said doctor blade seal, and said upper seat portion having an upper seat inner seal wall received into said recess.

17. A seal assembly for preventing toner leakage from a toner cartridge, comprising:

a first j-seal having a first upper seat portion;

a second j-seal having a second upper seat portion;

a doctor blade seal extending between said first j-seal and said second j-seal with ends of said doctor blade seal disposed within said first upper seat portion and said second upper seat portion;

each of said first and second upper seat portions having an upper seat inner seal wall and an upper seat outer seal wall with a gap defined between each of said upper seat inner and outer seal walls; and said doctor blade seal having a corresponding tongue disposed within each of said gaps for interlocking said first and second j-seals with said doctor blade seal and said tongues sealing corners defined by a doctor blade and a doctor blade bracket in said toner cartridge.

18. The seal assembly of claim 17 further comprising an upper tapered edge on said upper seat outer seal wall.

19. The seal assembly of claim 17 wherein said upper seat inner seal wall is disposed at an acute angle with respect to said upper seat outer seal wall.

20. The seal assembly of claim 17 further comprising a doctor blade assembly.

21. The seal assembly of claim 20 wherein said doctor blade assembly captures said doctor blade seal within said first and second upper seat portions of said j-seals when mounted in said cartridge.

* * * * *